United States Patent [19]

Cary

[11] 4,340,349

[45] Jul. 20, 1982

[54] APPARATUS FOR REPAIRING HOT SPOTS IN A REFRACTORY LINED WALL

[76] Inventor: Larry R. Cary, 214 Brandt Pl., Hobart, Ind. 46342

[21] Appl. No.: 111,451

[22] Filed: Jan. 11, 1980

[51] Int. Cl.[3] ..... B28B 1/48

[52] U.S. Cl. ..... 425/290; 408/104; 425/295

[58] Field of Search ..... 425/290, 292, 296, 297, 425/295; 408/104, 115 R, 147

[56] References Cited

U.S. PATENT DOCUMENTS 1,747,192 2/1930 Strand ..... 425/290
3,448,497 6/1969 Arnold ..... 425/290
3,899,265 8/1975 Lang ..... 425/290

*Primary Examiner*—John A. Parrish
*Attorney, Agent, or Firm*—Walter P. Wood; Rea C. Helm

[57] ABSTRACT

A method and apparatus for repairing "hot spots" in a refractory lined wall, applicable especially to blast furnaces. A plurality of relatively closely spaced couplings are affixed in advance to a metal shell which overlies the refractory lining. When a hot spot is observed, a jig is installed successively on couplings overlying the hot spot and holes are drilled in the shell. The couplings accommodate a grouting machine which injects grouting material through the holes.

4 Claims, 3 Drawing Figures

APPARATUS FOR REPAIRING HOT SPOTS IN A REFRACTORY LINED WALL

This invention relates to an improved method and apparatus for repairing "hot spots" in a refractory lined wall.

My invention is particularly useful as applied to repair of hot spots in the wall of a blast furnace, but it may be used for repair of walls of other structures where similar problems are encountered. The wall of a conventional blast furnace is formed of a metal shell and a lining of refractory brickwork. Sometimes the wall develops a hot spot where the lining wears thin. The usual practices in repairing a hot spot involve a number of steps and are unduly costly and time-consuming.

One practice is to drill holes through the shell at the hot spot with electric drills held in place with magnets and inject grouting material through the holes. The shell usually has a poor surface condition and the magnets do not hold very well. It is necessary to drill first a pilot hole and then a larger hole for injecting the grouting material. A short length of pipe is welded to the shell to accommodate the grouting machine. Finally the hole is closed. Another practice is to weld a jig, known as an "old man", to the outside of the shell at the hot spot and drill a hole through the shell with an air-driven drill supported on the jig. No separate pilot hole is needed. The jig is burned off and welded to the shell at a new location. The remainder of the repair operation is similar to that already described. Repairs can be made only when the furnace is down. If the furnace is down for only 6 to 8 hours, as is common, only a very few holes can be drilled and grouted by either method.

An object of my invention is to provide an improved method and apparatus for repairing hot spots in a refractory lined wall in which I make repairs more expeditiously and at less cost than in the practices used heretofore.

A further object is to provide an improved repair method and apparatus in which I equip the shell of a refractory lined wall with a plurality of relatively closed spaced couplings affixed beforehand and utilize the couplings first to mount a jig for supporting a drill, and next to accommodate a grouting machine.

A further object is to provide improved repair apparatus which embodies a novel jig cooperable with couplings affixed to the shell of a refractory lined wall for supporting a drill.

Figure 1:
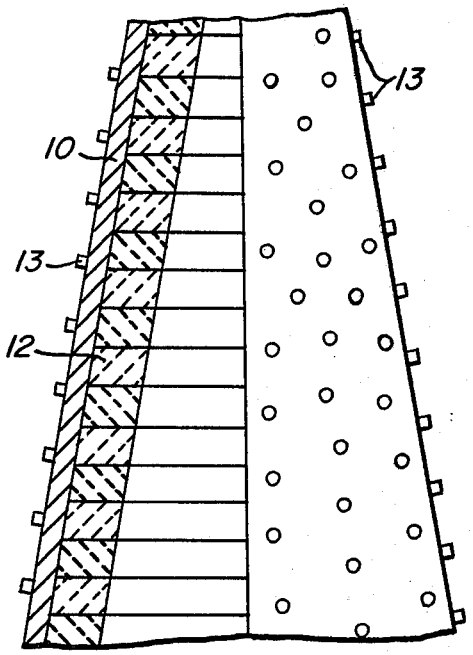
FIG. 1 is a diagrammatic side elevational view, partly in section and not to scale, of a portion of a blast furnace which has couplings affixed to the shell in accordance with my invention.

FIG. 1 shows a portion of a blast furnace which includes a metal shell 10 and a lining 12 of refractory brickwork. In accordance with my invention, I weld or otherwise affix a plurality of relatively closely spaced couplings 13 to the outside of the shell over a relatively large area. Conveniently the couplings may be spaced about 3 feet apart throughout the furnace wall, but the spacing and the area covered may vary and are not critical. The couplings are affixed in advance to a new or existing furnace, usually before there is any problem of hot spots. The furnace may be conventional apart from the couplings and hence is not shown in detail.

Figure 2:
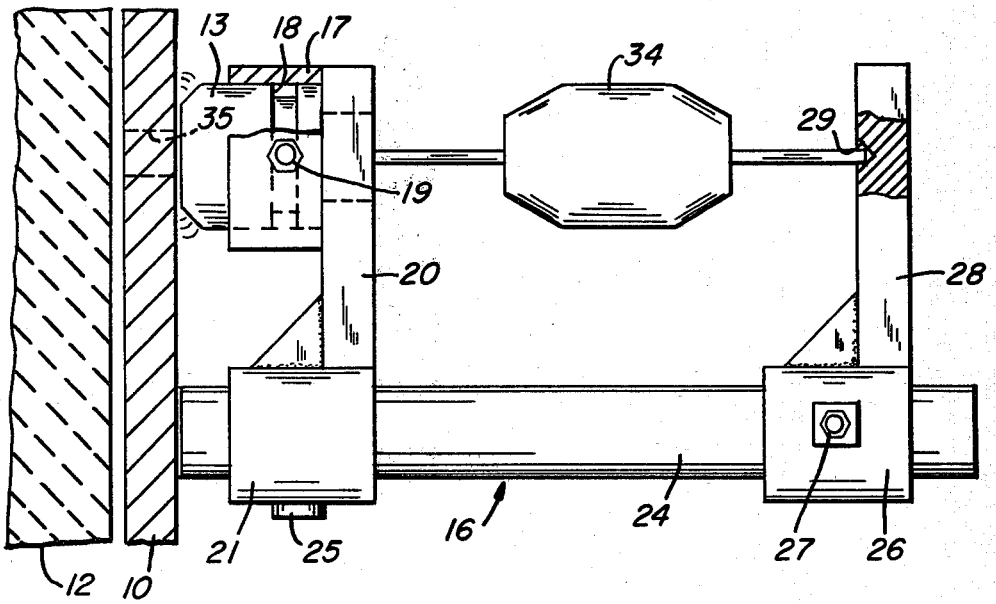
FIG. 2 is a side elevational view, partly in section, of a jig and drill mounted on one of the couplings shown in in FIG. 1, the jig being constructed in accordance with my invention.

FIG. 2 shows a jig 16 constructed in accordance with my invention mounted on one of the couplings 13. The jig includes a socket member 17 which receives the coupling. The coupling is internally threaded and has a groove 18 extending around its circumference. A locking bolt 19 threadedly engages the socket member and is received within groove 18 to fasten the jig to the shell. A depending hanger 20 is fixed to the socket member 17 and a sleeve 21 is fixed to the lower end of the hanger.

Figure 3:
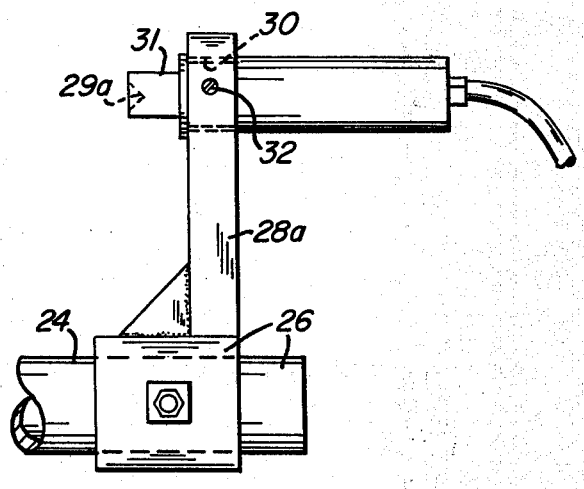
FIG. 3 is a fragmentary side elevational view showing a modified form of jig.

An elongated pipe or bar 24 is slidably received in sleeve 21 and held in adjusted position by a set screw 25. One end of the pipe abuts the shell 10 below the coupling 13 to steady the jig. A second sleeve 26 is slidably mounted on the pipe and held in adjusted position by a set screw 27. An upstanding post 28 is fixed to the sleeve 26 and has a center notch 29 axially aligned with the socket member 17. FIG. 3 shows a modification in which the post **28*a* has a hole 30. An adapter 31 is received in this hole and held in place by a set screw 32. The adapter has a center notch 29*a***.

The jig 16 supports a drill 34, which may be air driven, hydraulically driven or electrically driven. The back end of the drill is received in the center notch 29 or **29*a*. The drill extends through the coupling 13 in a position to drill a hole 35 through the shell 10. The position of the sleeve 26 and/or adapter 31** may be adjusted to fit the drill.

In accordance with my repair method, I equip the furnace with couplings 13 as already described. When I observe a hot spot in the furnace wall, I mount the jig 16 and drill 34 successively on couplings 13 overlying the hot spot the next time the furnace is down. I drill holes in the shell 10 at each such coupling. After removing the jig from each coupling, I inject grouting material through each hole, using a conventional grouting machine (not shown). The coupling is designed to accommodate the grouting machine. Thereafter I apply plugs to the couplings through which I have drilled and thus close the holes.

From the foregoing description it is seen that my invention affords a simple expeditious method and apparatus for repairing hot spots in the wall of a blast furnace or other structure. Use of the invention enables a hole to be drilled and grouting material injected in only about fifteen minutes. Consequently it is possible to inject grouting material throughout a relatively large area during a brief down period.

I claim:

1. Apparatus for repairing hot spots in a wall which has a metal shell and a refractory lining, said apparatus comprising a plurality of relatively closely spaced couplings affixed in advance to said shell over a relatively large area, a jig adapted to be removably mounted on any of said couplings which overlies a hot spot, a drill adapted to be supported on said jig for drilling a hole through said shell at the coupling on which said jig is mounted whereby grouting material may be injected through said hole, and with said coupling being adapted for plugging after injection of grouting materials.

2. Apparatus as defined in claim 1 in which said jig comprises a socket member for receiving the coupling and adjustable means connected to said socket member for supporting said drill and which includes means for locking said socket member to said coupling.

3. Apparatus as defined in claim 2 in which said adjustable member includes a hanger depending from said socket member, a sleeve fixed to the lower end of said hanger, an elongated member slidably received in said sleeve and adapted to abut said shell below said coupling to steady the jig, a second sleeve slidably mounted on said elongated member, a post upstanding from said second sleeve, and centering means carried by said post.

4. Apparatus as defined in claim 3 comprising in addition an adapter mounted on said post, said centering means being on said adapter.

* * * * *